US010021475B2

(12) United States Patent
Koido et al.

(10) Patent No.: US 10,021,475 B2
(45) Date of Patent: Jul. 10, 2018

(54) HEADSET

(71) Applicant: Panasonic Intellectual Property Management Co., Ltd., Osaka (JP)

(72) Inventors: Teppei Koido, Osaka (JP); Suguru Nakao, Hyogo (JP); Hirosi Kunimoto, Osaka (JP); Shuji Yamashita, Nara (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 15/277,292

(22) Filed: Sep. 27, 2016

(65) Prior Publication Data

US 2017/0180841 A1 Jun. 22, 2017

(30) Foreign Application Priority Data

Dec. 21, 2015 (JP) ..... 2015-248165
Jul. 13, 2016 (JP) ..... 2016-138501

(51) Int. Cl.
*H04R 1/10* (2006.01)
*H04R 1/46* (2006.01)

(52) U.S. Cl.
CPC ..... *H04R 1/1041* (2013.01); *H04R 1/105* (2013.01); *H04R 1/46* (2013.01); *H04R 2460/13* (2013.01)

(58) Field of Classification Search
CPC ..... H04R 1/46; H04R 1/1041; H04R 1/1091; H04R 25/456
USPC ..... 381/71.11, 71.6, 151, 312, 380, 324; 455/11.1, 575.2; 600/23, 418; 700/94; 704/231
See application file for complete search history.

(56) References Cited

U.S. PATENT DOCUMENTS 5,986,813 A * 11/1999 Saikawa ..... G02B 27/017 359/630
6,456,721 B1 * 9/2002 Fukuda ..... H04R 1/1066 381/151
6,463,157 B1 * 10/2002 May ..... H04R 1/083 310/324
7,010,139 B1 * 3/2006 Smeehuyzen ..... H04R 1/10 381/376
8,767,996 B1 * 7/2014 Lin ..... H04R 1/1091 381/370
9,264,793 B2 * 2/2016 Brown ..... H04R 1/1091
9,438,988 B2 * 9/2016 Campbell ..... H04R 1/1091
9,622,000 B2 * 4/2017 Horii ..... H04R 1/1016
9,681,222 B2 * 6/2017 Park ..... H04R 1/46
9,740,842 B1 * 8/2017 Wong ..... G06F 21/32
2004/0197002 A1 10/2004 Atsumi et al.
(Continued)

FOREIGN PATENT DOCUMENTS

JP 11-331970 11/1999
JP 2003-018683 1/2003
(Continued)

*Primary Examiner* — Gerald Gauthier
(74) *Attorney, Agent, or Firm* — McDermott Will & Emery LLP

(57) ABSTRACT

A headset supported on a head of a wearer while passing around the head includes a bone conduction speaker, a contact type microphone, a frame that supports the bone conduction speaker and has elasticity, and a movable part configured to change a distance between the bone conduction microphone and the frame. This configuration can provide a headset that is easily worn by the wearer.

17 Claims, 6 Drawing Sheets

(56) References Cited

U.S. PATENT DOCUMENTS

2004/0229667 A1* 11/2004 Tsai ..... H04M 1/0258 455/575.2
2005/0033571 A1* 2/2005 Huang ..... G10L 15/20 704/231
2005/0197565 A1* 9/2005 Yagi ..... A61B 5/055 600/418
2009/0185699 A1* 7/2009 Kim ..... H04R 1/1066 381/151
2009/0296965 A1* 12/2009 Kojima ..... H04R 25/407 381/312
2011/0135106 A1* 6/2011 Yehuday ..... H04R 1/1083 381/71.6
2011/0170718 A1* 7/2011 Fukuda ..... H04R 1/1075 381/151
2011/0293105 A1* 12/2011 Arie ..... H04M 1/05 381/71.11
2011/0301729 A1* 12/2011 Heiman ..... H04S 7/301 700/94
2012/0087519 A1* 4/2012 Emilsson ..... G10K 11/1786 381/151
2012/0130154 A1* 5/2012 Sajan ..... G10L 21/06 600/23
2013/0196721 A1* 8/2013 Waterman ..... H04M 1/05 455/575.2
2013/0288596 A1* 10/2013 Suzuki ..... B63C 11/26 455/40
2015/0289052 A1* 10/2015 Takeda ..... H04R 1/02 381/151
2015/0373450 A1* 12/2015 Black ..... H04R 5/033 455/11.1
2016/0037272 A1* 2/2016 Gebert ..... H04R 25/604 381/324
2016/0142818 A1* 5/2016 Park ..... H04R 3/02 381/151
2017/0180841 A1* 6/2017 Koido ..... H04R 1/1041

FOREIGN PATENT DOCUMENTS

JP 2004-032340 1/2004
JP 2008-263383 10/2008
JP 2012-123456 6/2012

* cited by examiner

HEADSET

BACKGROUND

1. Technical Field

The present disclosure relates to a headset using bone conduction.

2. Description of the Related Art

Unexamined Japanese Patent Publication No. 2008-263383 discloses a headset. The headset includes a microphone and a speaker.

SUMMARY

The present disclosure provides a headset that is easily worn by a wearer.

The headset of the present disclosure is a headset supported on a head of the wearer while passing around the head, and includes a bone conduction speaker, a contact type microphone, a frame that supports the bone conduction speaker and has elasticity, and a movable part configured to change a distance between the contact type microphone and the frame.

The headset of the present disclosure can provide a headset that is easily worn by the wearer.

DETAILED DESCRIPTION

Hereinafter, exemplary embodiments will be described in detail, with reference to drawings as appropriate. Here, any detailed description which is more than necessary may be omitted. For example, the detailed description of a well-known matter or the repeated description with respect to the substantially same configuration may be omitted. All of such omissions are intended to facilitate understanding by those skilled in the art by preventing the following description from becoming unnecessarily redundant.

It is noted that, the appended drawings and the following description are provided for those skilled in the art to fully understand the present disclosure, and it is not intended to limit the subject matter described in the claims by the appended drawings and the following description.

Exemplary Embodiment

Hereafter, an exemplary embodiment will be described with reference to FIGS. 1 to 5.

Figure 1:
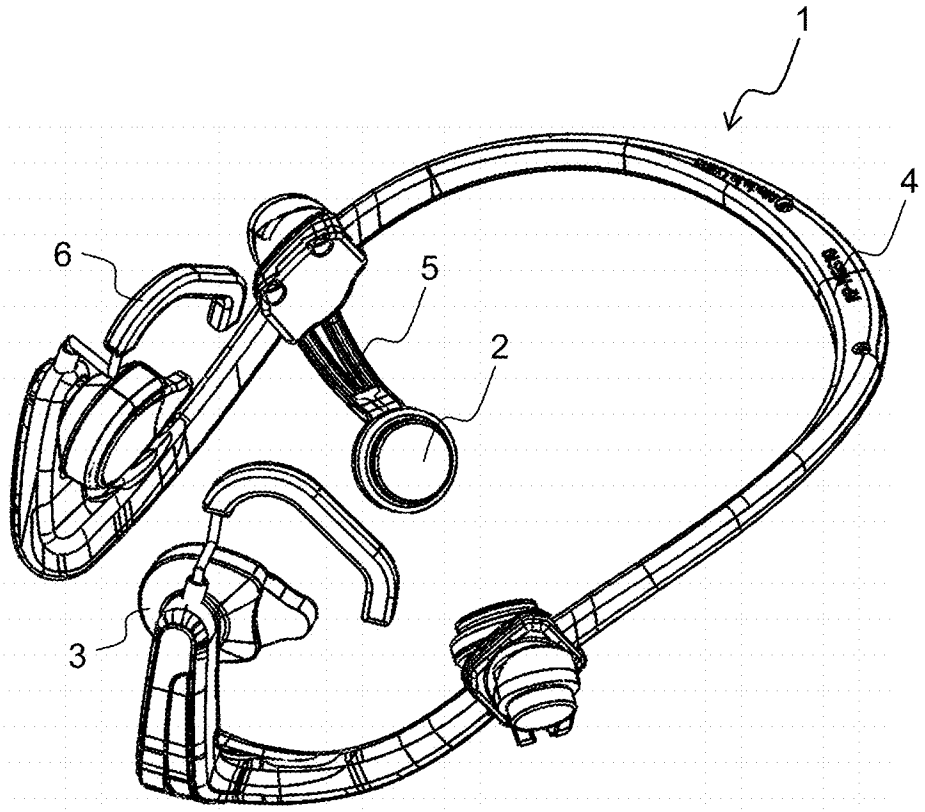
FIG. 1 is an external view of a headset of an exemplary embodiment.

FIG. 1 is an external view of a headset of the exemplary embodiment. In FIG. 1, headset 1 includes microphones 2, speakers 3, frame 4, movable parts 5, and hooks 6.

Each microphone 2 is a contact type microphone. The contact type microphone includes a pharynx microphone that collects voice by tightly sticking the microphone on a throat of a wearer, a bone conduction microphone that obtains voice of the wearer by utilizing bone conduction, and the like. Although two microphones (contact type microphones) are disposed as microphones 2 of the present disclosure, so as to obtain voice from both right and left sides of the wearer, single microphone 2 may be used.

Each speaker 3 is a bone conduction speaker that conducts sound to the wearer by utilizing bone conduction. Although two speakers are disposed as speakers 3 of the present disclosure, so as to conduct sound from both right and left sides of the wearer, single speaker 3 may be disposed.

Frame 4 is directly attached with speakers 3, and is disposed between two ears of the wearer passing around the head of the wearer.

Further, frame 4 has elasticity and is supported to the wearer with the elasticity. Specifically, when the wearer does not wear headset 1, frame 4 is smaller than the head of the wearer. When the wearer wears headset 1, frame 4 is expanded outward, and is supported to the wearer with its restoring force.

Further, frame 4 is adapted to extend from the part below one of the two ears of the wearer to the other while passing around a rear part of the head of the wearer. Frame 4 has a shape along an upper part of the head, as frame 4 extends from both parts below the two ears to the rear part of the head. This configuration allows frame 4 not to touch a collar or a rear part of a body of the wearer, even when the wearer turns his or her head upward.

Movable parts 5 have elasticity and press both microphones 2 against the wearer with the elasticity. As will be described in detail later, the wearer can change positions of microphones 2 by moving movable parts 5.

Here, each movable part 5 has a space in a center thereof. This configuration secures flexibility in a twisting direction (a rotary direction around a straight line connecting each microphone 2 and a portion at which each corresponding movable part 5 is mounted on frame 4), and causes force to be applied in an inward direction of frame 4 (laterally pressing direction).

As illustrated in FIG. 1, movable parts 5 preferably have a curved shape such that only microphones 2 can be pressed against the wearer.

Hooks 6 are to be hooked on the ears of the wearer to prevent headset 1 from being out of alignment. Each hook 6 is formed of silicon rubber including a wire or the like in a center thereof and is designed to fit a shape of each ear of the wearer. Further, each hook 6 is made thinner than frame 4 to allow glasses, goggles, or the like to be hooked on the ears together with hooks 6. Here, hooks 6 may have other shapes or may be formed of other materials.

Figure 2:
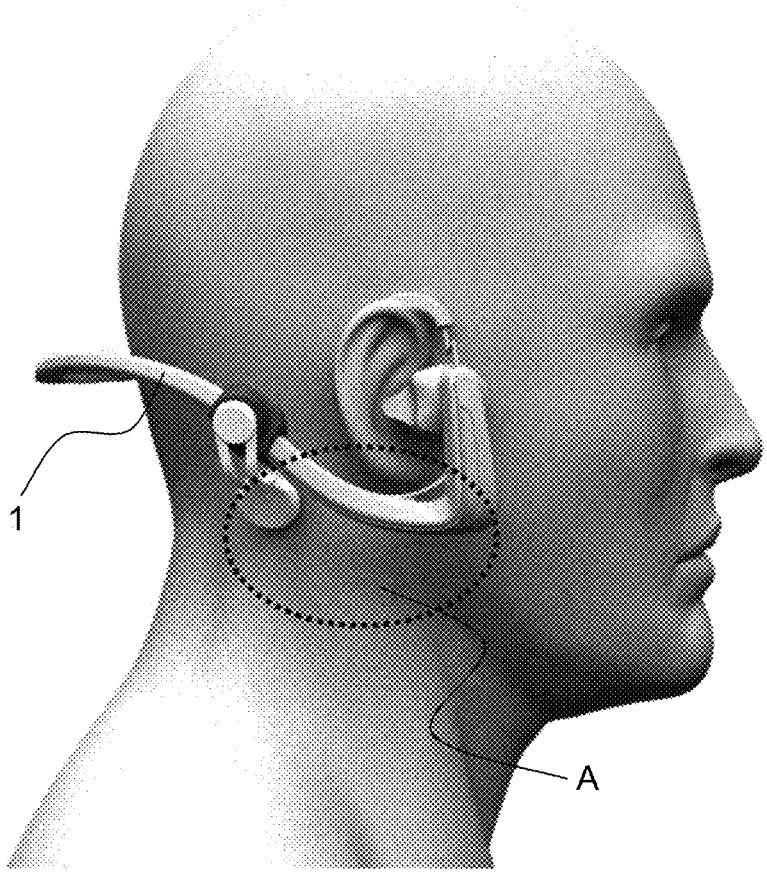
FIG. 2 is an image diagram of the headset of the exemplary embodiment, in a worn state.

FIG. 2 is an image diagram of the headset of the exemplary embodiment, in a worn state. That is, FIG. 2 illustrates an image in which the wearer wears headset 1.

Figure 3:
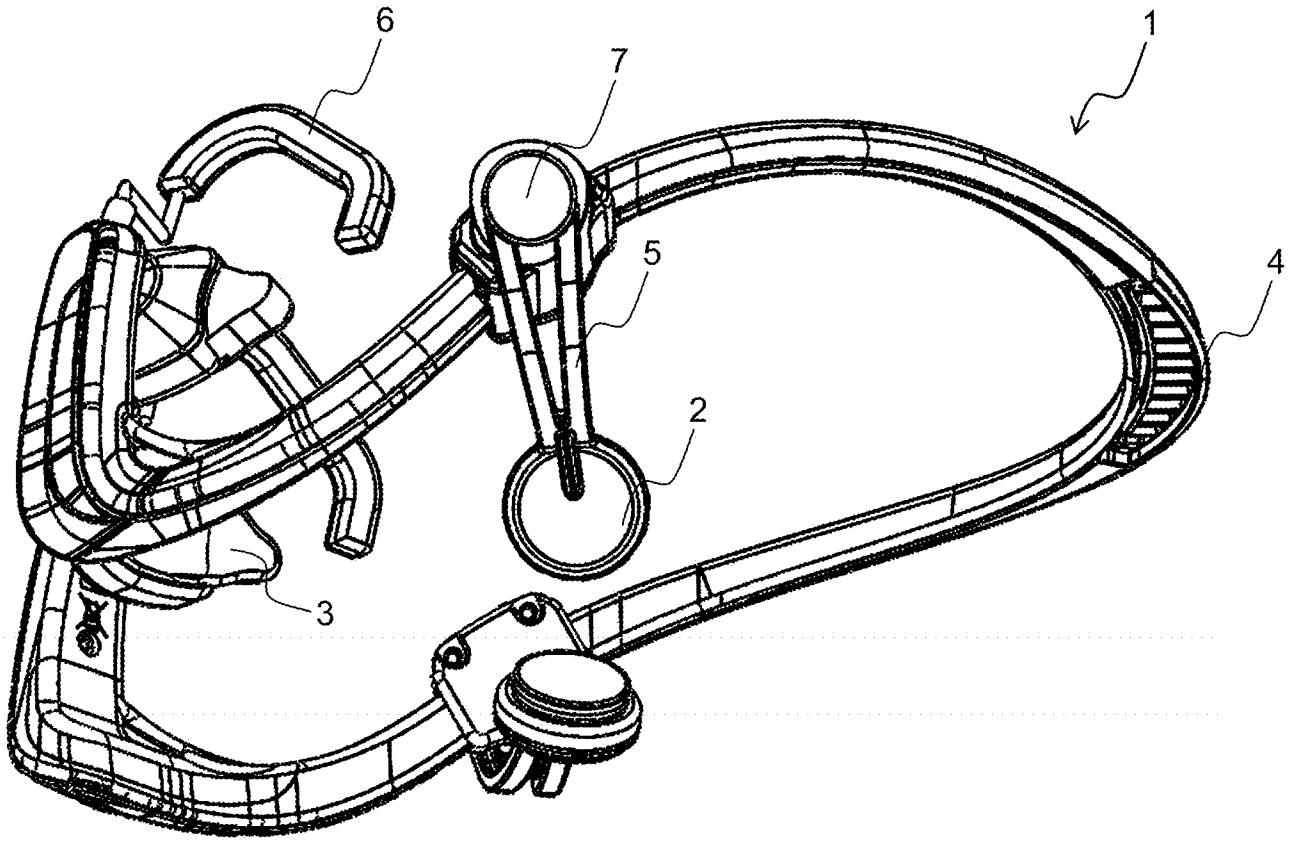
FIG. 3 is an operation diagram of movable parts of the exemplary embodiment.
Figure 4:
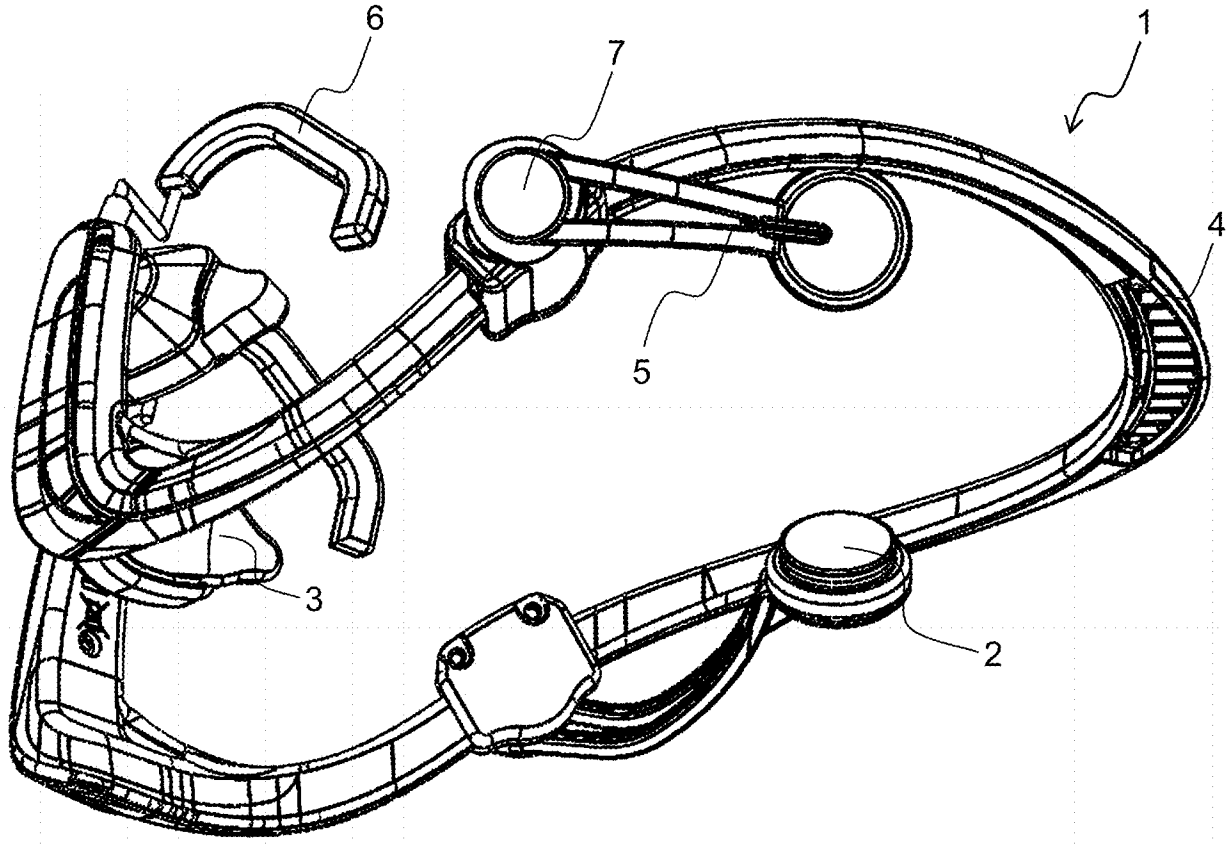
FIG. 4 is an operation diagram of the movable parts of the exemplary embodiment.

FIGS. 3 and 4 are operation diagrams of the movable parts of the exemplary embodiment. FIG. 3 illustrates positions of microphones 2 when headset 1 is worn. FIG. 4 illustrates positions of microphones 2 when headset 1 is not worn.

Figure 5:
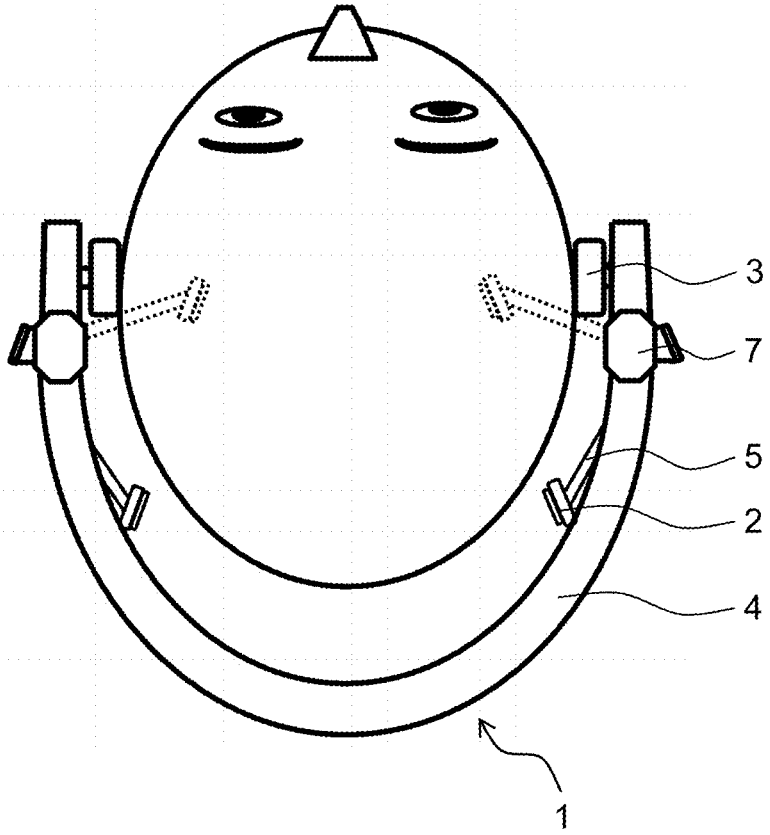
FIG. 5 is an operation diagram of microphones of the exemplary embodiment.

FIG. 5 is an operation diagram of the microphones of the exemplary embodiment.

In a case of the pharynx microphones used, each microphone 2 is mounted so as to be located around area A in FIG.

2, that is, around an area extending from a part below each ear to a part behind each ear, in order to obtain spoken voice by utilizing voice vibration generated near the throat of the wearer. Whereas in a case of the bone conduction microphones used, each microphone 2 is mounted within area A in FIG. 2, in order to obtain spoken voice by utilizing bone conduction.

Speakers 3 are mounted to be respectively placed near the ears. A shape of each speaker 3 is designed such that each speaker 3 is placed in intimate contact with a tragus of the wearer. With such a shape, sound caused by bone conduction is more easily conducted, and is more easily heard by the wearer.

It is noted that, microphones 2 are fixed to the head from both sides of the wearer with the elasticity of frame 4 and movable parts 5, and speakers 3 are fixed to the head from both sides of the wearer with the elasticity of frame 4.

Further, each movable part 5 is configured to support each corresponding microphone 2 from a part behind each corresponding ear.

A movement of each movable part 5 of headset 1 configured above will be described in detail with reference to FIGS. 3 to 5.

Movable parts 5 include rotatable parts 7, and each movable part 5 is rotatable around each corresponding rotatable part 7. As illustrated in FIG. 3, in a state of headset 1 worn by the wearer, each microphone 2 is located at a position apart from frame 4, to be close to each corresponding ear. That is, each microphone 2 is placed so as to be located in an interior side of frame 4. Placing each microphone 2 at this position allows each microphone 2 to be pressed to an appropriate area (area A in FIG. 2), when the wearer wears headset 1.

Here, since a size of the head or the like varies for every wearer, a position of each microphone 2 in headset 1 varies for every wearer. However, the rotatable function of rotatable part 7 of each movable part 5 allows the position of each corresponding microphone 2 to be freely set in a rotary direction of rotatable part 7. Therefore, it becomes possible to adjust each microphone 2 so as to be located at a position within area A illustrated in FIG. 2 for every wearer.

If frame 4 is smaller than the head of the wearer and microphones 2 are fixed in the interior side of frame 4, the wearer needs to expand both frame 4 and microphones 2 outward in order to wear headset 1, resulting in inconvenience for the wearer.

Then, as illustrated in FIG. 4, each movable part 5 is rotated around each corresponding rotatable part 7 to place each microphone 2 close to frame 4. This configuration allows microphones 2 not to disturb wearing headset 1, and the wearer can wear headset 1 only by expanding frame 4. This facilitates wearing headset 1.

It is noted that, at this time, it is preferable that each microphone 2 is wide at a portion close to frame 4 and is thin at a portion far from frame 4 since headset 1 is easily placed in intimate contact with the wearer when the wearer wears headset 1.

Next, the positions of microphones 2 will be described in detail with reference to FIG. 5. With respect to microphones 2 and movable parts 5 in FIG. 5, positions denoted by solid lines correspond to the positions of microphones 2 and movable parts 5 in FIG. 4, and positions denoted by broken lines correspond to the positions of microphones 2 and movable parts 5 in FIG. 3.

As illustrated in FIG. 5, in a state in which headset 1 is worn, the wearer uses microphones 2 at the positions denoted by the broken lines, and presses each microphone 2 around area A illustrated in FIG. 2.

On the other hand, in a state in which headset 1 is about to be worn, the wearer moves microphones 2 to the positions denoted by the solid lines in FIG. 5. Microphones 2 moved to these positions are closer to frame 4, in comparison with the state in which headset 1 is worn (a distance between each microphone 2 and frame 4 can be changed). In addition, as illustrated in FIG. 5, microphones 2 located around a back part of the head of the wearer do not disturb wearing headset 1. Therefore, the wearer can easily wear headset 1.

Here, movable parts 5 change the positions of microphones 2 by rotation, but may change the positions of microphones 2 by sliding microphones 2 along frame 4, for example. Further, the positions of microphones 2 may be changed by folding back respective microphones 2 toward opposite sides to each other (outer sides of frame 4) while interposing frame 4. Alternatively, an arm of each movable part 5 may extend and retract, or slide.

However, taking easiness of wearing headset 1 into consideration, microphones 2 are more preferably made movable by using a single mechanical element that, for example, rotates microphones 2 around rotatable parts 7 as described above, without combining several mechanical elements including rotating microphones 2 around rotatable parts 7, sliding microphones 2, and the like.

As described above, in the exemplary embodiment, the positions of microphones 2 are made movable. This allows the wearer to easily wear headset 1, and to optimally adjust the positions of microphones 2.

Other Embodiments

As described above, the exemplary embodiment has been described as an exemplary technique disclosed in the present application. However, the technique in the present disclosure is not limited to the described exemplary embodiment, and can be applied to exemplary embodiments to which modifications, substitutions, additions, omissions, and the like are made.

Then, hereinafter, another exemplary embodiment will be described.

Figure 6:
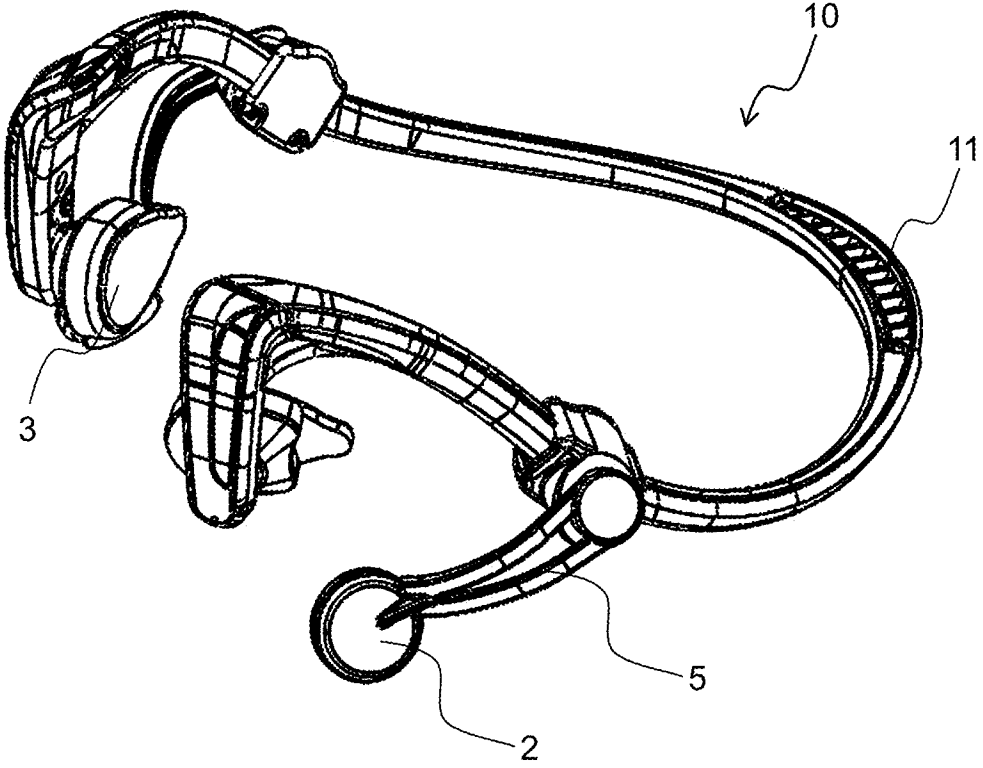
FIG. 6 is an external view of a headset of another exemplary embodiment.

FIG. 6 is an external view of a headset of another exemplary embodiment. In FIG. 6, when glasses or goggles are not used together with headset 10, frame 11 of headset 10 may have a shape in which frame 11 is directly hooked on two ears.

Further, the frame is designed to pass around the rear part of the wearer, but the frame may be designed to pass around a top part of the head or the like. However, as described above, positions attached with microphones 2 are below the ears. Therefore, the configuration in which the frame passes close to parts below the ears is more preferable since the movable parts can be made smaller.

It is noted that, since the aforementioned exemplary embodiments are to exemplify the technique in the present disclosure, various modifications, substitutions, additions, and omissions may be performed within a scope of claims and equivalents to the claims.

The present disclosure can provide a headset that is easily worn by a wearer, and can be applied to a headset using contact type microphones.

What is claimed is:

1. A headset comprising:

a bone conduction speaker;

a contact type microphone;

a frame that supports the bone conduction speaker and has elasticity; and a movable part configured to change a distance between the contact type microphone and the frame, wherein the movable part includes a rotatable mechanism that allows the movable part to press the contact type microphone against a wearer that wears the headset.

2. The headset according to claim 1, wherein the frame supports a pair of the bone conduction speakers from parts below ears of the wearer when the headset is worn.

3. The headset according to claim 1, further comprising hooks to be respectively hooked to ears of the wearer.

4. The headset according to claim 1, wherein the contact type microphone includes a pharynx microphone.

5. The headset according to claim 1, wherein the contact type microphone is placed so as to be located in an interior side of the frame.

6. The headset according to claim 1, wherein the frame supports a pair of the contact type microphones, and a pair of the movable parts are configured to change distances between the pair of the contact type microphones and the frame respectively.

7. The headset according to claim 1, wherein the movable part has elasticity and presses the contact type microphone against the wearer with the elasticity.

8. The headset according to claim 1, wherein the movable part includes a connecting member that connects the contact type microphone to the rotatable mechanism.

9. The headset according to claim 8, wherein a width of the connecting member on a side of the rotatable mechanism is larger than a width of the connecting member on a side of the contact type microphone.

10. The headset according to claim 8, wherein:

the connecting member includes two bars, and each of the two bars connects the contact type microphone to the rotatable mechanism.

11. The headset according to claim 10, wherein a distance between the two bars on a side of the rotatable mechanism is larger than a distance between the two bars on a side of the contact type microphone.

12. The headset according to claim 8, wherein:

the frame includes an inner surface that faces the wearer when the wearer wears the headset, and the connecting member is attached to the contact type microphone in an area of an inner surface side of the frame.

13. The headset according to claim 12, wherein:

the frame includes an outer surface opposite to the inner surface, and the connecting member is attached to the rotatable mechanism at a portion of an outer surface side of the frame.

14. The headset according to claim 12, wherein the rotatable mechanism is configured such that the contact type microphone rotates only in the area of the inner surface side of the frame.

15. The headset according to claim 1, wherein the rotatable mechanism is configured such that the contact type microphone rotates around an axis that crosses a part of the frame where the rotating mechanism is attached to the frame.

16. A headset comprising:

a bone conduction speaker;

a contact type microphone;

a frame that supports the bone conduction speaker and has elasticity; and a movable part that connects the contact type microphone to the frame, wherein the movable part is configured to slide along the frame.

17. A headset comprising:

two bone conduction speakers;

a first contact type microphone and a second contact type microphone;

a frame that supports the bone conduction speakers and has elasticity;

a first movable part that connects the first contact type microphone to the frame; and a second movable part that connects the second contact type microphone to the frame, wherein the first and second movable parts are configured to rotate the first and second contact type microphones such that the first and second contact type microphones clamp a wearer from both sides, when the headset is worn by the wearer.

* * * * *